US009458674B2

(12) United States Patent
Lyons

(10) Patent No.: US 9,458,674 B2
(45) **Date of Patent: *Oct. 4, 2016**

(54) EARTH-BORING TOOLS INCLUDING SHAPED CUTTING ELEMENTS, AND RELATED METHODS

(71) Applicant: Baker Hughes Incorporated, Houston, TX (US)

(72) Inventor: Nicholas J. Lyons, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/686,093

(22) Filed: Apr. 14, 2015

(65) Prior Publication Data

US 2015/0218890 A1 Aug. 6, 2015

Related U.S. Application Data

(63) Continuation of application No. 13/204,459, filed on Aug. 5, 2011, now Pat. No. 9,022,149.

(60) Provisional application No. 61/371,554, filed on Aug. 6, 2010.

(51) Int. Cl.

| | |
|---|---|
| ***E21B 10/567*** | (2006.01) |
| ***B24D 18/00*** | (2006.01) |
| ***B24D 99/00*** | (2010.01) |
| ***C22C 1/05*** | (2006.01) |
| ***C22C 29/08*** | (2006.01) |
| ***E21B 3/00*** | (2006.01) |
| ***E21B 10/52*** | (2006.01) |

(52) U.S. Cl.

CPC ..... *E21B 10/5673* (2013.01); *B24D 18/00* (2013.01); *B24D 99/005* (2013.01); *C22C 1/05* (2013.01); *C22C 29/08* (2013.01); *E21B 3/00* (2013.01); *E21B 10/52* (2013.01); *E21B 10/567* (2013.01)

(58) Field of Classification Search

CPC ..... E21B 10/5673; E21B 3/00; E21B 10/52; E21B 10/567; B24D 18/00; B24D 99/005; C22C 1/05

USPC ..... 175/57, 430, 434, 426, 307

See application file for complete search history.

(56) References Cited

U.S. PATENT DOCUMENTS

| | | | |
|---|---|---|---|
| 3,459,073 | A | 8/1969 | Conover |
| 4,373,593 | A | 2/1983 | Phaal et al. |

(Continued)

FOREIGN PATENT DOCUMENTS

| | | | |
|---|---|---|---|
| CA | 2598057 | A1 | 3/2008 |
| CN | 2743526 | Y | 11/2005 |
| EP | 972908 | A2 | 1/2005 |
| GB | 2086451 | A | 5/1982 |

OTHER PUBLICATIONS

Canadian Office Action for Canadian Application No. 2807231 dated Dec. 30, 2014, 3 pages.

Bilen et al., U.S. Appl. No. 61/596,433 entitled, Shaped Cutting Elements for Earth-Boring Tools, Earth-Boring Tools Including Such Cutting Elements, and Related Methods, filed Feb. 8, 2012.

International Search Report for International Application No. PCT/US2011/046820 dated Feb. 9, 2012, 3 pages.

International Written Opinion for International Application No. PCT/US2011/046820 dated Feb. 9, 2012, 3 pages.

International Preliminary Report on Patentability for International Application No. PCT/US2011/046820 dated Feb. 12, 2012, 4 pages.

Chinese Office Action and Search Report for Chinese application No. 201180039361.1 dated Jun. 25, 2014.

*Primary Examiner* — Michael Wills, III

(74) *Attorney, Agent, or Firm* — TraskBritt

(57) ABSTRACT

A cutting element for an earth-boring tool. The cutting element comprises a substrate base, and a volume of polycrystalline diamond material on an end of the substrate base. The volume of polycrystalline diamond material comprises a generally conical surface, an apex centered about a longitudinal axis extending through a center of the substrate base, a flat cutting surface extending from a first point at least substantially proximate the apex to a second point on the cutting element more proximate a lateral side surface of the substrate base. Another cutting element is disclosed, as are a method of manufacturing and a method of using such cutting elements.

20 Claims, 9 Drawing Sheets

(56) References Cited

U.S. PATENT DOCUMENTS 4,440,247 A 4/1984 Sartor
4,471,845 A 9/1984 Jurgens
4,499,958 A 2/1985 Radtke et al.
4,602,691 A 7/1986 Weaver
4,705,124 A 11/1987 Abrahamson et al.
4,718,505 A 1/1988 Fuller
4,722,405 A 2/1988 Langford, Jr.
4,823,892 A 4/1989 Fuller
4,832,139 A 5/1989 Minikus et al.
4,854,405 A 8/1989 Stroud
4,869,330 A 9/1989 Tibbitts
4,889,017 A 12/1989 Fuller et al.
4,942,933 A 7/1990 Barr et al.
4,981,184 A 1/1991 Knowlton et al.
RE33,757 E 12/1991 Weaver
5,172,777 A 12/1992 Siracki
5,172,779 A 12/1992 Siracki et al.
5,186,268 A 2/1993 Clegg
5,244,039 A 9/1993 Newton
5,303,785 A 4/1994 Duke
5,322,138 A 6/1994 Siracki et al.
5,379,853 A 1/1995 Lockwood et al.
5,415,244 A 5/1995 Portwood
5,421,423 A 6/1995 Huffstutler
5,487,436 A 1/1996 Griffin
5,505,273 A 4/1996 Azar
5,531,281 A 7/1996 Murdock
5,542,485 A 8/1996 Pessier et al.
5,549,171 A 8/1996 Mensa et al.
5,558,170 A 9/1996 Thigpen et al.
5,592,995 A 1/1997 Scott et al.
5,595,252 A 1/1997 O'Hanlon
5,607,024 A 3/1997 Keith
5,649,604 A 7/1997 Fuller
5,697,462 A 12/1997 Grimes et al.
5,706,906 A 1/1998 Jurewicz et al.
5,720,357 A 2/1998 Fuller et al.
5,813,485 A 9/1998 Portwood
5,871,060 A 2/1999 Jensen et al.
5,881,828 A 3/1999 Fischer et al.
5,890,552 A 4/1999 Scott et al.
5,904,213 A 5/1999 Caraway et al.
5,957,227 A 9/1999 Besson et al.
5,967,246 A 10/1999 Caraway et al.
5,992,547 A 11/1999 Caraway et al.
6,000,483 A 12/1999 Jurewicz et al.
6,053,263 A 4/2000 Meiners
6,059,054 A 5/2000 Portwood et al.
6,089,336 A 7/2000 Nexton et al.
6,092,613 A 7/2000 Caraway et al.
6,098,730 A 8/2000 Scott et al.
6,105,694 A 8/2000 Scott
6,129,161 A 10/2000 Roberts et al.
6,142,250 A 11/2000 Griffin et al.
6,176,333 B1 1/2001 Doster
6,202,770 B1 3/2001 Jurewicz et al.
6,209,420 B1 4/2001 Butcher et al.
6,227,318 B1 5/2001 Siracki
6,241,035 B1 6/2001 Portwood
6,290,008 B1 9/2001 Portwood et al.
6,302,224 B1 10/2001 Sherwood, Jr.
6,328,117 B1 12/2001 Berzas et al.
6,332,503 B1 12/2001 Pessier et al.
6,401,844 B1 6/2002 Doster
6,408,958 B1 6/2002 Isbell et al.
6,571,891 B1 6/2003 Smith et al.
6,601,662 B2 8/2003 Matthias et al.
6,612,383 B2 9/2003 Desai et al.
6,615,934 B2 9/2003 Mensa-Wilmot
6,739,417 B2 5/2004 Smith et al.
6,997,273 B2 2/2006 Singh
7,011,169 B2 3/2006 Eason
7,025,156 B1 4/2006 Caraway
7,152,703 B2 12/2006 Meiners et al.
7,216,565 B2 5/2007 Sherwood, Jr. et al.
7,546,888 B2 6/2009 Cruz
7,588,102 B2 9/2009 Hall et al.
7,594,554 B2 9/2009 Schwefe et al.
7,628,233 B1 12/2009 Hall et al.
7,641,002 B2 1/2010 Hall et al.
7,690,442 B2 4/2010 Portwood et al.
7,798,257 B2 9/2010 Shen et al.
7,836,978 B2 11/2010 Scott
8,016,059 B2 9/2011 Gatell
8,028,774 B2 10/2011 Hall et al.
8,061,457 B2 11/2011 Hall et al.
8,205,692 B2 6/2012 McDonough et al.
8,215,420 B2 7/2012 Hall et al.
8,365,845 B2 2/2013 Hall et al.
8,505,634 B2 8/2013 Lyons et al.
8,534,767 B2 9/2013 Hall et al.
8,567,532 B2 10/2013 Hall et al.
8,616,305 B2 12/2013 Hall et al.
8,678,111 B2 3/2014 Zahradnik et al.
8,714,285 B2 5/2014 Hall et al.
8,851,207 B2 10/2014 Gavia et al.
8,960,337 B2 2/2015 Hall et al.
2003/0034180 A1 2/2003 Mensa-Wilmot
2004/0094334 A1 5/2004 Singh
2004/0149493 A1 8/2004 McDonough
2004/0184944 A1 9/2004 Geving et al.
2004/0231894 A1 11/2004 Dvorachek
2005/0023043 A1 2/2005 Tufts
2005/0263327 A1 12/2005 Meiners et al.
2006/0131075 A1 6/2006 Cruz
2006/0249309 A1 11/2006 Cruz
2007/0039761 A1 2/2007 Cruz
2007/0106487 A1 5/2007 Gavia et al.
2007/0199739 A1 8/2007 Schwefe et al.
2007/0261890 A1 11/2007 Cisneros
2007/0272445 A1 11/2007 Cariveau et al.
2008/0029312 A1 2/2008 Hall et al.
2008/0035380 A1 2/2008 Hall et al.
2008/0035387 A1 2/2008 Hall et al.
2008/0099251 A1 5/2008 Hall et al.
2008/0156543 A1 7/2008 McDonough et al.
2008/0173482 A1 7/2008 Hall et al.
2008/0179106 A1 7/2008 Gavia et al.
2008/0179107 A1 7/2008 Doster
2008/0179108 A1 7/2008 McClain et al.
2008/0223622 A1 9/2008 Duggan et al.
2008/0264695 A1 10/2008 Zahradnik et al.
2008/0302575 A1 12/2008 Durairajan et al.
2008/0314647 A1 12/2008 Hall et al.
2009/0020339 A1 1/2009 Sherwood, Jr.
2009/0051211 A1 2/2009 Hall et al.
2009/0055135 A1 2/2009 Tang et al.
2009/0126998 A1 5/2009 Zahradnik et al.
2009/0133938 A1 5/2009 Hall et al.
2009/0145669 A1 6/2009 Durairajan et al.
2009/0266619 A1 10/2009 Durairajan et al.
2009/0273224 A1 11/2009 Hall
2010/0065338 A1 3/2010 Hall et al.
2010/0065339 A1 3/2010 Hall et al.
2010/0071964 A1 3/2010 Hall et al.
2010/0155149 A1 6/2010 Keshavan et al.
2010/0263939 A1 10/2010 Hall et al.
2010/0326740 A1 12/2010 Hall et al.
2011/0042150 A1 2/2011 Hall et al.
2011/0083906 A1 4/2011 Hall et al.
2011/0155472 A1 6/2011 Lyons et al.
2011/0192651 A1 8/2011 Lyons et al.
2012/0023833 A1 2/2012 Hall et al.
2012/0031674 A1 2/2012 Lyons
2012/0125687 A1 5/2012 Rives
2012/0205163 A1 8/2012 Azar et al.
2012/0261977 A1 10/2012 Hall et al.
2012/0279785 A1 11/2012 Gavia et al.
2013/0199856 A1 8/2013 Bilen et al.
2015/0034394 A1 2/2015 Gavia et al.

EARTH-BORING TOOLS INCLUDING SHAPED CUTTING ELEMENTS, AND RELATED METHODS

CROSS-REFERENCE TO RELATED APPLICATIONS

This application is a continuation of U.S. patent application Ser. No. 13/204,459, filed Aug. 5, 2011, now U.S. Pat. No. 9,022,149, issued May 5, 2015, which application claims the benefit of U.S. Provisional Patent Application Ser. No. 61/371,554, filed Aug. 6, 2010. The subject matter of this application is also related to the subject matter of U.S. Provisional Patent Application Ser. No. 61/330,757, which was filed May 3, 2010. The disclosures of the above-identified applications are hereby incorporated herein in their entirety by this reference.

TECHNICAL FIELD

Embodiments of the present invention relate generally to cutting elements that include a table of superabrasive material (e.g., polycrystalline diamond or cubic boron nitride) formed on a substrate, to earth-boring tools including such cutting elements, and to methods of forming and using such cutting elements and earth-boring tools.

BACKGROUND

Earth-boring tools are commonly used for forming (e.g., drilling and reaming) bore holes or wells (hereinafter "wellbores") in earth formations. Earth-boring tools include, for example, rotary drill bits, core bits, eccentric bits, bicenter bits, reamers, underreamers, and mills.

Different types of earth-boring rotary drill bits are known in the art including, for example, fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore.

The drill bit is coupled, either directly or indirectly, to an end of what is referred to in the art as a "drill string," which comprises a series of elongated tubular segments connected end-to-end that extends into the wellbore from the surface of the formation. Often various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is attached, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore.

Rolling-cutter drill bits typically include three roller cones attached on supporting bit legs that extend from a bit body, which may be formed from, for example, three bit head sections that are welded together to form the bit body. Each bit leg may depend from one bit head section. Each roller cone is configured to spin or rotate on a bearing shaft that extends from a bit leg in a radially inward and downward direction from the bit leg. The cones are typically formed from steel, but they also may be formed from a particle-matrix composite material (e.g., a cermet composite such as cemented tungsten carbide). Cutting teeth for cutting rock and other earth formations may be machined or otherwise formed in or on the outer surfaces of each cone. Alternatively, receptacles are formed in outer surfaces of each cone, and inserts formed of hard, wear resistant material are secured within the receptacles to form the cutting elements of the cones. As the rolling-cutter drill bit is rotated within a wellbore, the roller cones roll and slide across the surface of the formation, which causes the cutting elements to crush and scrape away the underlying formation.

Fixed-cutter drill bits typically include a plurality of cutting elements that are attached to a face of bit body. The bit body may include a plurality of wings or blades, which define fluid courses between the blades. The cutting elements may be secured to the bit body within pockets formed in outer surfaces of the blades. The cutting elements are attached to the bit body in a fixed manner, such that the cutting elements do not move relative to the bit body during drilling. The bit body may be formed from steel or a particle-matrix composite material (e.g., cobalt-cemented tungsten carbide). In embodiments in which the bit body comprises a particle-matrix composite material, the bit body may be attached to a metal alloy (e.g., steel) shank having a threaded end that may be used to attach the bit body and the shank to a drill string. As the fixed-cutter drill bit is rotated within a wellbore, the cutting elements scrape across the surface of the formation and shear away the underlying formation.

Impregnated diamond rotary drill bits may be used for drilling hard or abrasive rock formations such as sandstones. Typically, an impregnated diamond drill bit has a solid head or crown that is cast in a mold. The crown is attached to a steel shank that has a threaded end that may be used to attach the crown and steel shank to a drill string. The crown may have a variety of configurations and generally includes a cutting face comprising a plurality of cutting structures, which may comprise at least one of cutting segments, posts, and blades. The posts and blades may be integrally formed with the crown in the mold, or they may be separately formed and attached to the crown. Channels separate the posts and blades to allow drilling fluid to flow over the face of the bit.

Impregnated diamond bits may be formed such that the cutting face of the drill bit (including the posts and blades) comprises a particle-matrix composite material that includes diamond particles dispersed throughout a matrix material. The matrix material itself may comprise a particle-matrix composite material, such as particles of tungsten carbide, dispersed throughout a metal matrix material, such as a copper-based alloy.

It is known in the art to apply wear-resistant materials, such as "hardfacing" materials, to the formation-engaging surfaces of rotary drill bits to minimize wear of those surfaces of the drill bits cause by abrasion. For example, abrasion occurs at the formation-engaging surfaces of an earth-boring tool when those surfaces are engaged with and sliding relative to the surfaces of a subterranean formation in the presence of the solid particulate material (e.g., formation cuttings and detritus) carried by conventional drilling fluid. For example, hardfacing may be applied to cutting teeth on the cones of roller cone bits, as well as to the gage surfaces of the cones. Hardfacing also may be applied to the exterior surfaces of the curved lower end or "shirttail" of each bit leg, and other exterior surfaces of the drill bit that are likely to engage a formation surface during drilling.

The cutting elements used in such earth-boring tools often include polycrystalline diamond cutters (often referred to as "PCDs"), which are cutting elements that include a polycrystalline diamond (PCD) material. Such polycrystalline diamond cutting elements are formed by sintering and bonding together relatively small diamond grains or crystals under conditions of high temperature and high pressure in the presence of a catalyst (such as, for example, cobalt, iron, nickel, or alloys and mixtures thereof) to form a layer of polycrystalline diamond material on a cutting element substrate. These processes are often referred to as high temperature/high pressure (or "HTHP") processes. The cutting element substrate may comprise a cermet material (i.e., a ceramic-metal composite material) such as, for example, cobalt-cemented tungsten carbide. In such instances, the cobalt (or other catalyst material) in the cutting element substrate may be drawn into the diamond grains or crystals during sintering and serve as a catalyst material for forming a diamond table from the diamond grains or crystals. In other methods, powdered catalyst material may be mixed with the diamond grains or crystals prior to sintering the grains or crystals together in an HTHP process.

Upon formation of a diamond table using an HTHP process, catalyst material may remain in interstitial spaces between the grains or crystals of diamond in the resulting polycrystalline diamond table. The presence of the catalyst material in the diamond table may contribute to thermal damage in the diamond table when the cutting element is heated during use due to friction at the contact point between the cutting element and the formation. Polycrystalline diamond cutting elements in which the catalyst material remains in the diamond table are generally thermally stable up to a temperature of about 750° Celsius, although internal stress within the polycrystalline diamond table may begin to develop at temperatures exceeding about 350° Celsius. This internal stress is at least partially due to differences in the rates of thermal expansion between the diamond table and the cutting element substrate to which it is bonded. This differential in thermal expansion rates may result in relatively large compressive and tensile stresses at the interface between the diamond table and the substrate, and may cause the diamond table to delaminate from the substrate. At temperatures of about 750° Celsius and above, stresses within the diamond table may increase significantly due to differences in the coefficients of thermal expansion of the diamond material and the catalyst material within the diamond table itself. For example, cobalt thermally expands significantly faster than diamond, which may cause cracks to form and propagate within the diamond table, eventually leading to deterioration of the diamond table and ineffectiveness of the cutting element.

In order to reduce the problems associated with different rates of thermal expansion in polycrystalline diamond cutting elements, so-called "thermally stable" polycrystalline diamond (TSD) cutting elements have been developed. Such a thermally stable polycrystalline diamond cutting element may be formed by leaching the catalyst material (e.g., cobalt) out from interstitial spaces between the diamond grains in the diamond table using, for example, an acid. All of the catalyst material may be removed from the diamond table, or only a portion may be removed. Thermally stable polycrystalline diamond cutting elements in which substantially all catalyst material has been leached from the diamond table have been reported to be thermally stable up to a temperatures of about 1200° Celsius. It has also been reported, however, that such fully leached diamond tables are relatively more brittle and vulnerable to shear, compressive, and tensile stresses than are non-leached diamond tables. In an effort to provide cutting elements having diamond tables that are more thermally stable relative to non-leached diamond tables, but that are also relatively less brittle and vulnerable to shear, compressive, and tensile stresses relative to fully leached diamond tables, cutting elements have been provided that include a diamond table in which only a portion of the catalyst material has been leached from the diamond table.

BRIEF DESCRIPTION OF THE SEVERAL VIEWS OF THE DRAWINGS

While the specification concludes with claims particularly pointing out and distinctly claiming what are regarded as embodiments of the present invention, various features and advantages of this invention may be more readily ascertained from the following description of example embodiments of the invention provided with reference to the accompanying drawings, in which:

DETAILED DESCRIPTION OF THE INVENTION

The illustrations presented herein are not meant to be actual views of any particular cutting element, earth-boring tool, or portion of a cutting element or tool, but are merely idealized representations which are employed to describe embodiments of the present invention. Additionally, elements common between figures may retain the same numerical designation.

As used herein, the term "earth-boring tool" means and includes any tool used to remove formation material and form a bore (e.g., a wellbore) through the formation by way of the removal of the formation material. Earth-boring tools include, for example, rotary drill bits (e.g., fixed-cutter or "drag" bits and roller cone or "rock" bits), hybrid bits including both fixed cutters and roller elements, coring bits, percussion bits, bi-center bits, reamers (including expandable reamers and fixed-wing reamers), and other so-called "hole-opening" tools.

As used herein, the term "apex," when used in relation to a shaped cutting element, means and includes the most distant point on a cutting tip of a shaped cutting element relative to a center of a basal surface on an opposing side of the cutting element.

Figure 2:
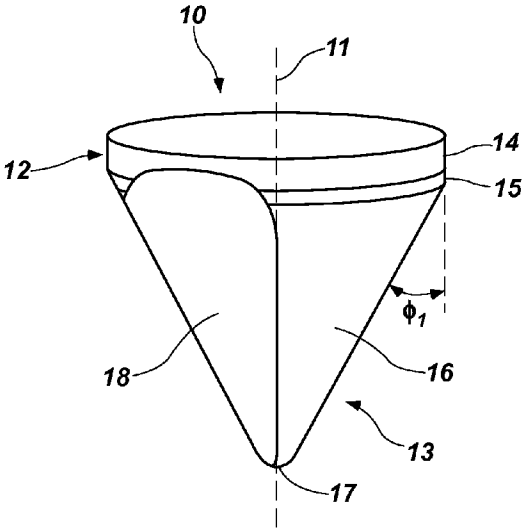
FIG. 2 is a perspective view of the cutting element shown in FIG. 1, taken from a viewpoint approximately forty-five degrees (45°) clockwise of that of FIG. 1.
Figure 3:
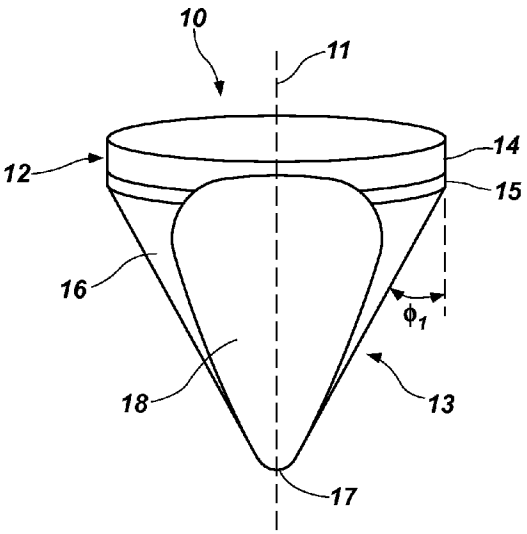
FIG. 3 is a front perspective view of the cutting element shown in FIG. 1, taken from a viewpoint approximately ninety degrees (90°) clockwise of that of FIG. 1.
Figure 1:
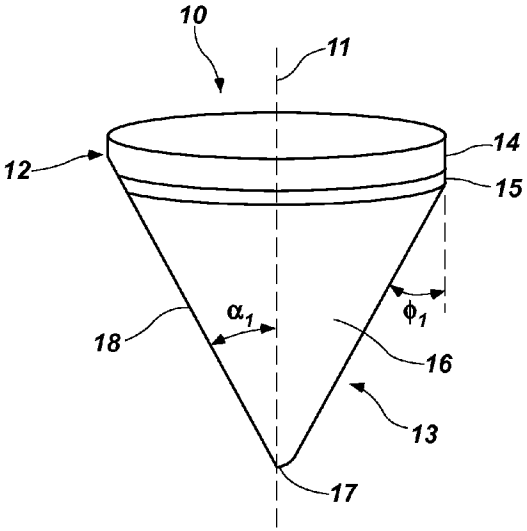
FIG. 1 is a side perspective view of an embodiment of a cutting element of the invention.

Referring to FIGS. 1-3, an embodiment of the present disclosure includes a cutting element 10 having a longitudinal axis 11, a substrate base 12, and a cutting tip 13. The substrate base 12 may have a generally cylindrical shape. The longitudinal axis 11 may extend through a center of the substrate base 12 in an orientation that may be at least substantially parallel to a lateral side surface 14 of the substrate base 12 (e.g., in an orientation that may be perpendicular to a generally circular cross-section of the substrate base 12). The lateral side surface 14 of the substrate base may be coextensive and continuous with a generally cylindrical lateral side surface 15 of the cutting tip 13. The cutting tip 13 also includes a generally conical surface 16, an apex 17, and a flat cutting surface 18. A portion of the generally conical surface 16 may extend between the edge of the flat cutting surface 18 and the generally cylindrical lateral side surface 15. The generally conical surface 16 may be defined by an angle $\phi_1$ existing between the generally conical surface 16 and a phantom line extending from the generally cylindrical lateral side surface 15 of the cutting tip 13. The angle $\phi_1$ may be within a range of from about thirty degrees (30°) to about sixty degrees (60°). The generally conical surface 16 may extend from the generally cylindrical lateral side surface 15 to the apex 17, and may extend to the edges of the flat cutting surface 18. The location of the apex 17 may be centered about the longitudinal axis 11. The flat cutting surface 18 may extend from a location at least substantially proximate the apex 17 to a location on the cutting element 10 at a selected or predetermined distance from the apex 17, such that an angle $\alpha_1$ between the longitudinal axis 11 and the flat cutting surface 18 may be within a range of from about fifteen degrees (15°) to about ninety degrees (90°). Portions of the cutting tip 13, such as the flat cutting surface 18, may be polished.

In FIGS. 1-3, the angle $\phi_1$ is about thirty degrees (30°), the apex 17 of the cutting tip 13 is centered about the longitudinal axis 11, and the flat cutting surface 18 extends from the apex 17 to the lateral side surface 14 of the substrate base 12. In turn, the angle $\alpha_1$ is less than thirty degrees (30°). FIG. 1 illustrates a side perspective view of the cutting element 10 showing the non-symmetrical configuration of the cutting tip 13 about the longitudinal axis 11. FIG. 2, which is a perspective view of the cutting element 10 taken from a viewpoint approximately 45 degrees clockwise of that of FIG. 1, shows the flat cutting surface 18 of the cutting tip 13. FIG. 3 illustrates a front perspective view of the cutting element 10, taken from a viewpoint approximately ninety degrees (90°) clockwise of that of FIG. 1, in which the cutting tip 13 is symmetrical about the longitudinal axis 11.

Figure 5:
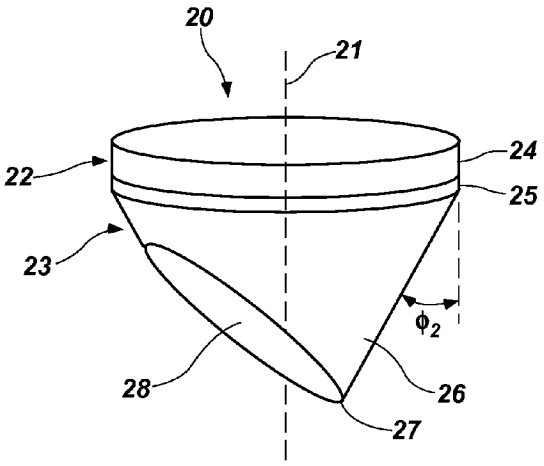
FIG. 5 is a perspective view of the cutting element shown in FIG. 4, taken from a viewpoint approximately forty-five degrees (45°) clockwise of that of FIG. 4.
Figure 6:
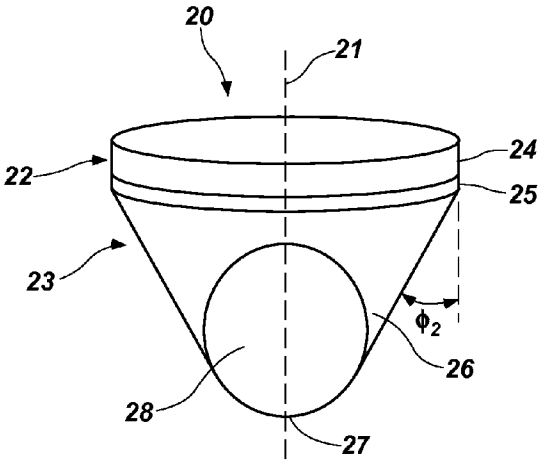
FIG. 6 is a front perspective view of the cutting element shown in FIG. 4, taken from a viewpoint approximately ninety degrees (90°) clockwise of that of FIG. 4.
Figure 4:
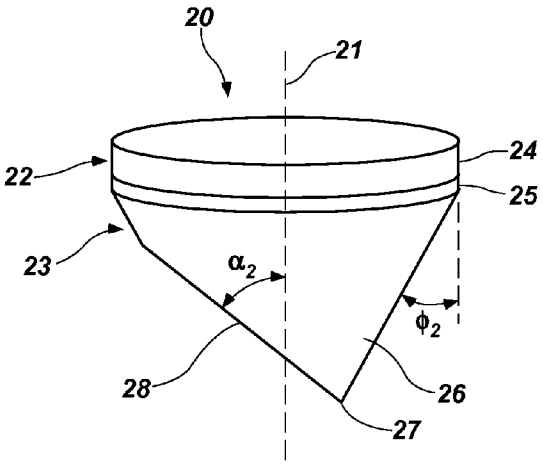
FIG. 4 is a side perspective view of another embodiment of a cutting element of the invention.

Referring to FIGS. 4-6, another embodiment of the present disclosure includes a cutting element 20 having a longitudinal axis 21, a substrate base 22, and a cutting tip 23. The substrate base 22 may have a generally cylindrical shape. The longitudinal axis 21 may extend through a center of the substrate base 22 in an orientation that may be at least substantially parallel to a lateral side surface 24 of the substrate base 22 (e.g., in an orientation that may be perpendicular to a generally circular cross-section of the substrate base 22). The lateral side surface 24 of the substrate base 22 may be coextensive and continuous with a generally cylindrical lateral side surface 25 of the cutting tip 23. The cutting tip 23 also includes a generally conical surface 26, an apex 27, and a flat cutting surface 28. A portion of the generally conical surface 26 may extend between the edge of the flat cutting surface 28 and the generally cylindrical lateral side surface 25 of the cutting tip 23. The generally conical surface 26 may be defined by an angle $(1)_2$ existing between the generally conical surface 26 and a phantom line extending from the generally cylindrical lateral side surface 25 of the cutting tip 23. The angle $\phi_2$ may be within a range of from about thirty degrees (30°) to about sixty degrees (60°). The generally conical surface 26 may extend from the generally cylindrical lateral side surface 25 to the apex 27, and may extend to the edges of the flat cutting surface 28. The location of the apex 27 may be offset from the longitudinal axis 21. The flat cutting surface 28 may extend from a location at least substantially proximate the apex 27 to a location on the cutting element 20 at a selected or predetermined distance from the apex 27, such that an angle $\alpha_2$ between the longitudinal axis 21 and the flat cutting surface 28 may be within a range of from about fifteen degrees (15°) to about ninety degrees (90°). Portions of the cutting tip 23, such as the flat cutting surface 28, may be polished.

In FIGS. 4-6 the angle $\phi_2$ is about thirty degrees (30°), the apex 27 is offset from the longitudinal axis 21, and the flat cutting surface 28 extends from the apex 27 to a location on the generally conical surface 26 of the cutting tip 23. The angle $\alpha_2$ is about sixty degrees (60°). The viewing angles represented by FIGS. 4-6 correspond, respectively, to those of FIGS. 1-3.

Each of the cutting tips 13 and 23 may comprise a polycrystalline diamond (PCD) material. Certain regions of the cutting tips 13 and 23, or the entire cutting tips 13 and 23, optionally may be processed (e.g., etched) to remove metal binder from between the interbonded diamond grains of the PCD material of each of the cutting tips 13 and 23, such that each of the cutting tips 13 and 23 are relatively more thermally stable. Each of the cutting tips 13 and 23 may be formed on their respective substrate bases 12 and 22, or each of the cutting tips 13 and 23 and their respective substrate bases 12 and 22 may be separately formed and subsequently attached together. Each of the substrate bases 12 and 22 may be formed from a material that is relatively hard and resistant to wear. As one non-limiting example, the substrate bases 12 and 22 may be at least substantially comprised of a cemented carbide material, such as cobalt-cemented tungsten carbide. Optionally, the cutting tips 13 and 23 may be formed for use without the respective substrate bases 12 and 22 (e.g., the substrate bases 12 and 22 may be omitted from the respective cutting elements 10 and 20). Optionally, an entirety of the cutting elements 10 and 20 (e.g., the cutting tips 13 and 23, and the substrate bases 12 and 22) may comprise a PCD material.

Figure 7:
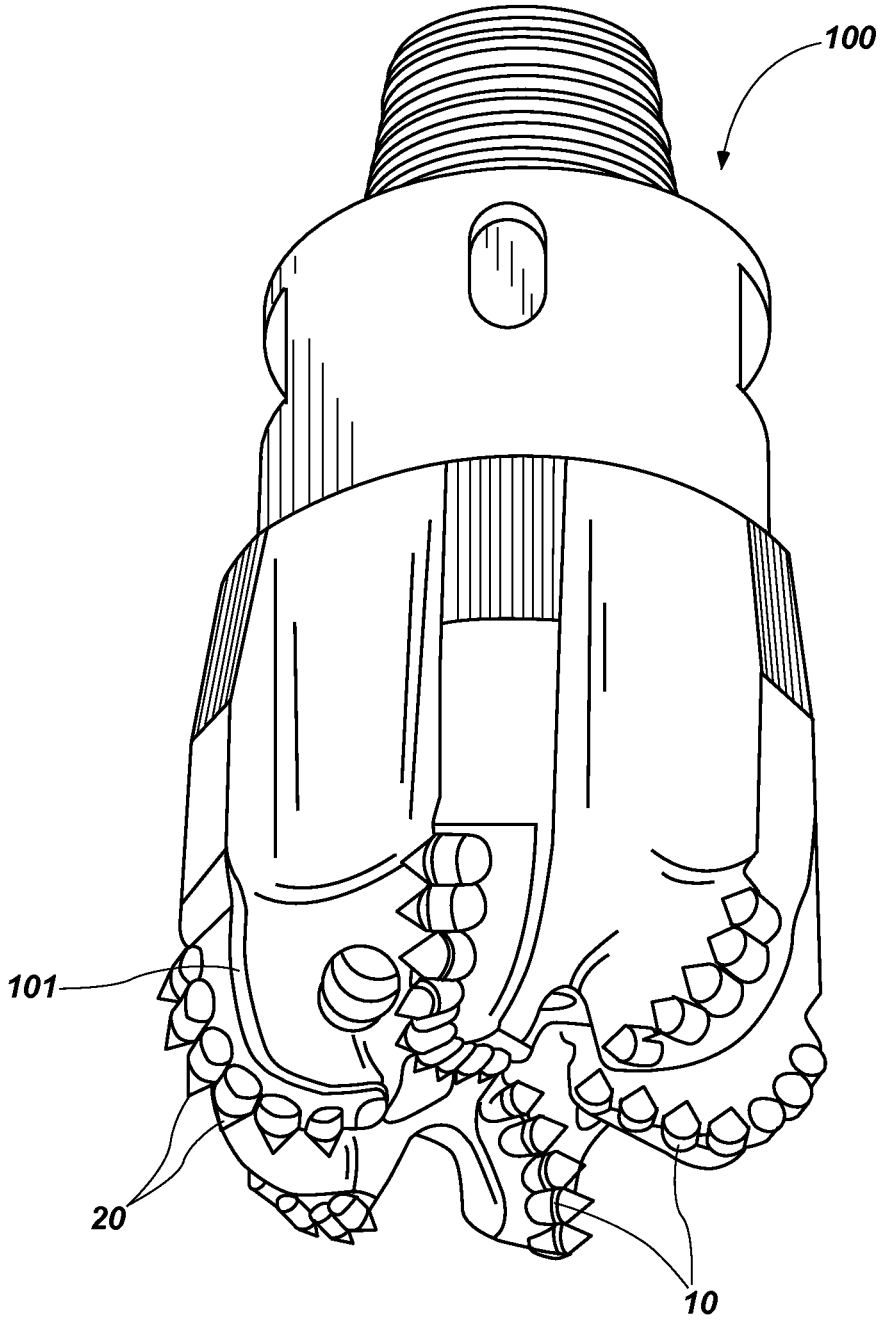
FIG. 7 is a perspective view of an embodiment of a fixed-cutter earth-boring rotary drill bit of the invention that includes cutting elements as described herein.
Figure 8:
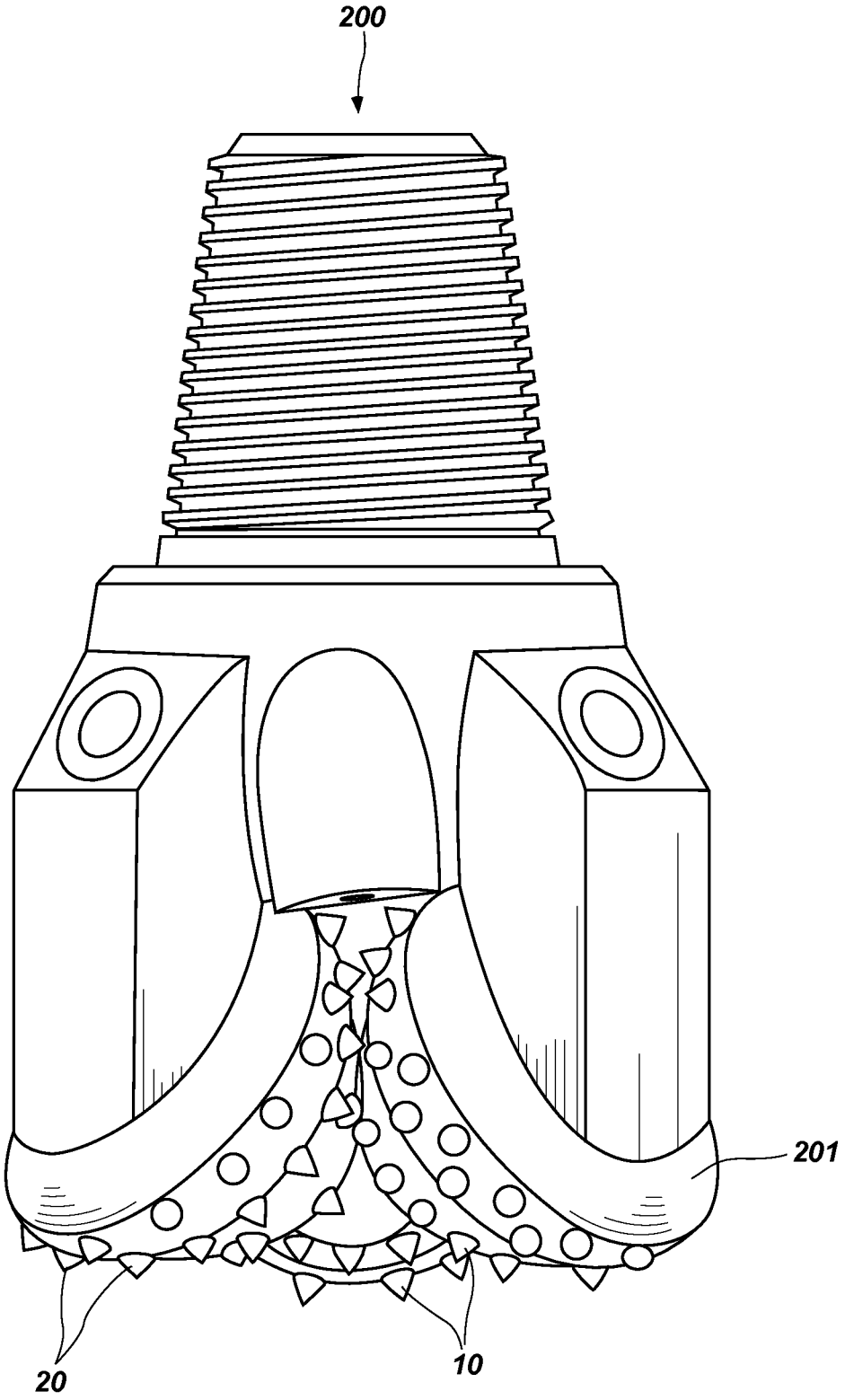
FIG. 8 is a front view of an embodiment of a roller cone earth-boring rotary drill bit of the invention that includes cutting elements as described herein.

Each of the cutting elements 10 and 20 may be attached to an earth-boring tool such that the respective cutting tips 13 and 23 will contact a surface of a subterranean formation within a wellbore during a drilling or reaming process. FIG. 7 is a simplified perspective view of a fix-cutter rotary drill bit 100, which includes a plurality of the cutting elements 10 and 20 attached to blades 101 on the body of the drill bit 100. In additional embodiments, the drill bit 100 may include only cutting elements 10. In yet further embodiments, the drill bit 100 may include only cutting elements 20. FIG. 8 is a simplified front view of a roller cone rotary drill bit 200, which includes a plurality of the cutting elements 10 and 20 attached to roller cones 201 thereof. In additional embodiments, the drill bit 200 may include only cutting elements 10. In yet further embodiments, the drill bit 200 may include only cutting elements 20.

Referring to FIGS. 9-18, the cutting elements 10 and 20 may each be attached to a portion 400 of the earth-boring tool such that at least a portion of the respective flat cutting surfaces 18 and 28 contact a surface 300 of the subterranean formation within the wellbore. The portion 400 of the earth-boring tool may be a portion of a fixed cutter earth-boring rotary drill bit, such as the drill bit 100 depicted in FIG. 7, or a portion of a roller cone earth-boring rotary drill bit, such as the drill bit 200 depicted in FIG. 8. A shape and configuration of each of the cutting elements 10 and 20 may enable versatility in orienting each of the cutting elements 10 and 20 relative to the surface 300 of the subterranean formation.

Figure 10:
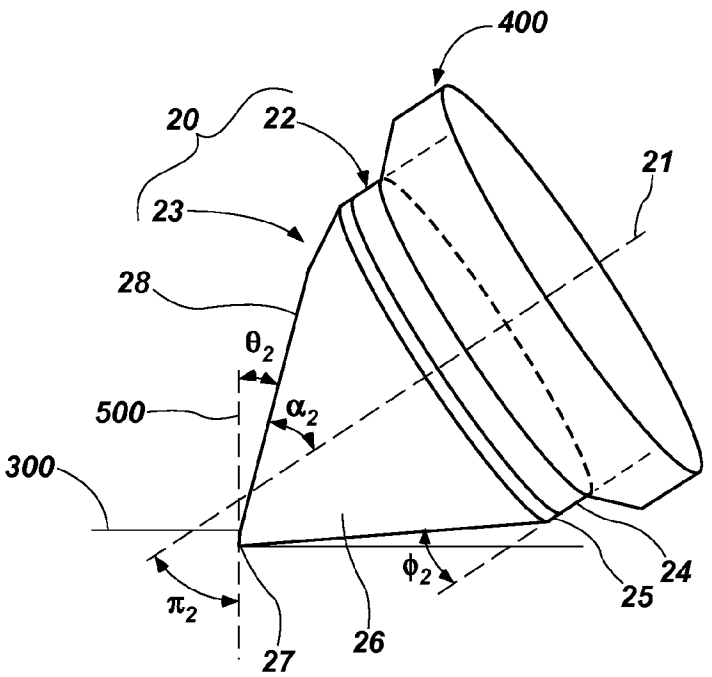
FIGS. 9 and 10 are side perspective views of different embodiments of cutting elements of the invention wherein the cutting elements are mounted on a drilling tool and provided with a negative physical back rake angle (e.g., physical forward rake) and a negative effective back rake angle (e.g., effective forward rake) relative to a formation surface.
Figure 9:
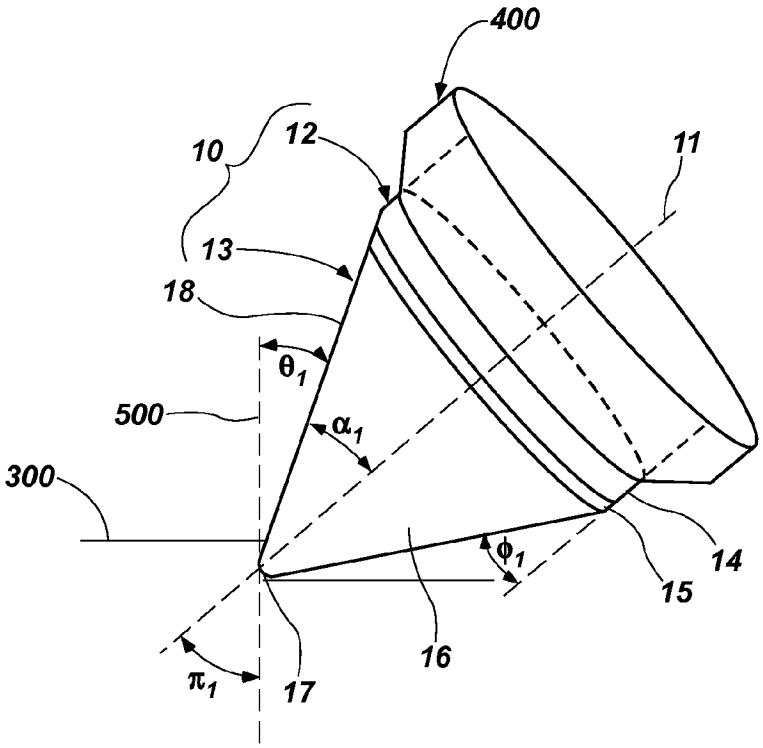
Figure 16:
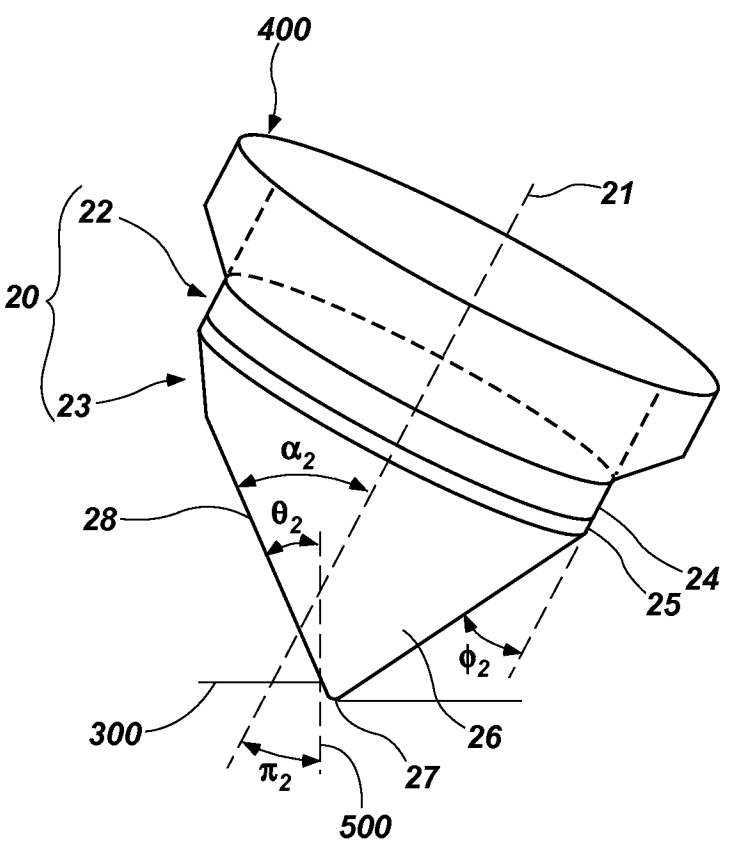
FIGS. 15 and 16 are side perspective views of different embodiments of cutting elements of the invention wherein the cutting elements are mounted on a drilling tool and provided with a negative physical back rake angle (e.g., physical forward rake) and a positive effective back rake angle (e.g., effective back rake) relative to a formation surface.
Figure 18:
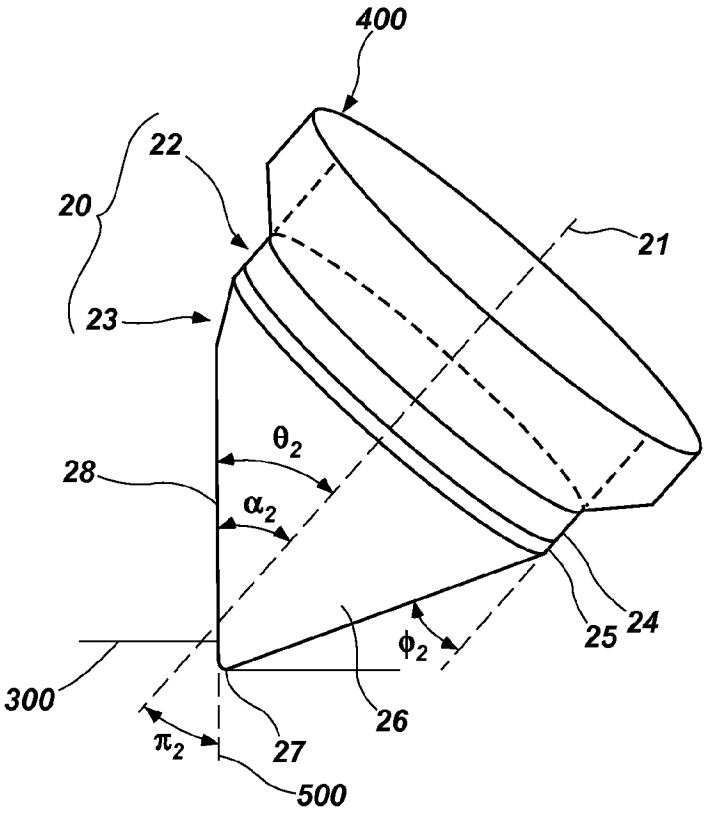
FIGS. 17 and 18 are side perspective views of different embodiments of cutting elements of the invention wherein the cutting elements are mounted on a drilling tool and provided with a negative physical back rake angle (e.g., physical forward rake) and a neutral effective back rake angle (e.g., effective neutral rake) relative to a formation surface.
Figure 17:
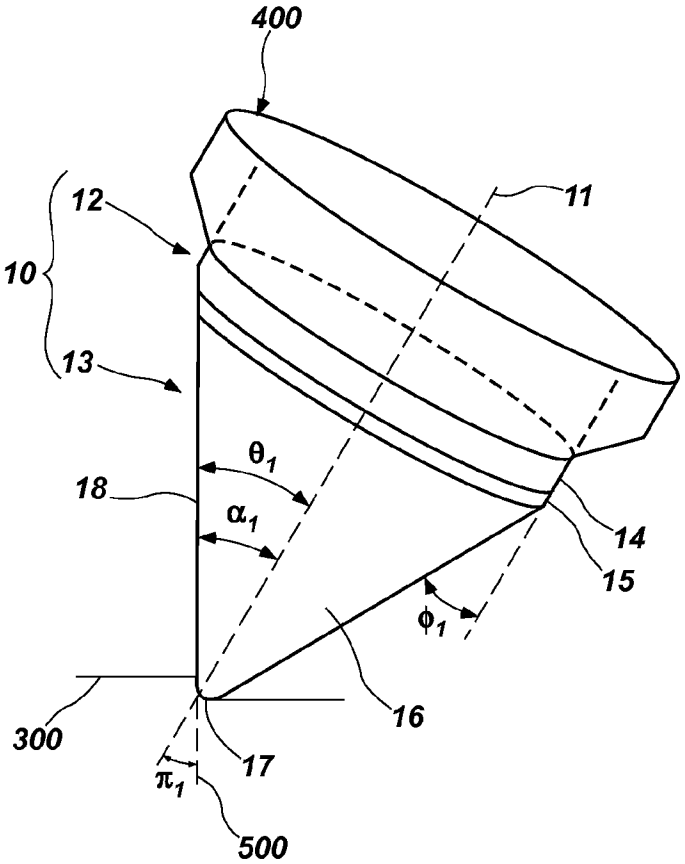

Referring to FIGS. 9-18, effective back rake angles $\theta_1$ and $\theta_2$ between the respective flat cutting surfaces 18 and 28 and a reference plane 500 at least substantially perpendicular to the surface 300 of the subterranean formation may be negative (i.e., effective forward rake), positive (i.e., effective back rake), or neutral (i.e., effective neutral rake). The effective back rake angles $\theta_1$ and $\theta_2$ may be considered negative where the corresponding flat cutting surfaces 18 and 28 are behind the reference plane 500 in the direction of cutter movement (i.e., the flat cutting surfaces 18 and 28 form an obtuse angle with the surface 300 of the subterranean formation), as depicted in FIGS. 9 and 10. The effective back rake angles $\theta_1$ and $\theta_2$ may be considered positive where the respective flat cutting surfaces 18 and 28 are ahead of the reference plane 500 in the direction of cutter movement (i.e., the flat cutting surfaces 18 and 28 form an acute angle with the surface of the subterranean formation 300), as depicted in FIGS. 11-16. The effective back rake angles $\theta_1$ and $\theta_2$ may be considered neutral where the respective flat cutting surfaces 18 and 28 are parallel with the reference plane 500 (i.e., the flat cutting surfaces 18 and 28 substantially form a right angle with the surface of subterranean formation 300), as depicted in FIGS. 17 and 18. In at least some embodiments, the effective back rake angles $\theta_1$ and $\theta_2$ of the corresponding cutting elements 10 and 20 may be within a range of from about thirty degrees (30°) negative back rake to about forty-five degrees (45°) positive back rake relative to the reference plane 500. Subterranean formation cuttings may be deflected over and across the flat cutting surfaces 18 and 28 in directions that may be up and away from the surface 300 of the subterranean formation.

Figure 12:
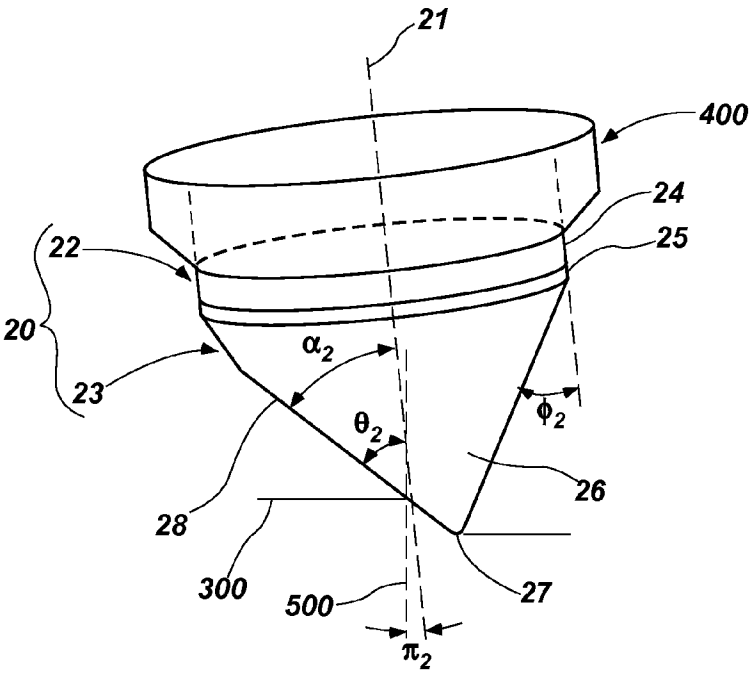
FIGS. 11 and 12 are side perspective views of different embodiments of cutting elements of the invention wherein the cutting elements are mounted on a drilling tool and provided with a positive physical back rake angle (e.g., physical back rake) and a positive effective back rake angle (e.g., effective back rake) relative to a formation surface.
Figure 11:
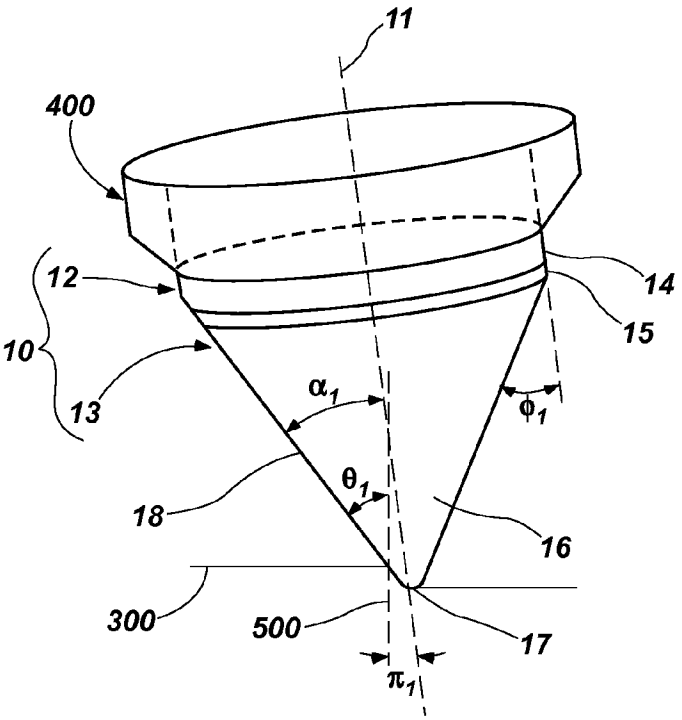
Figure 14:
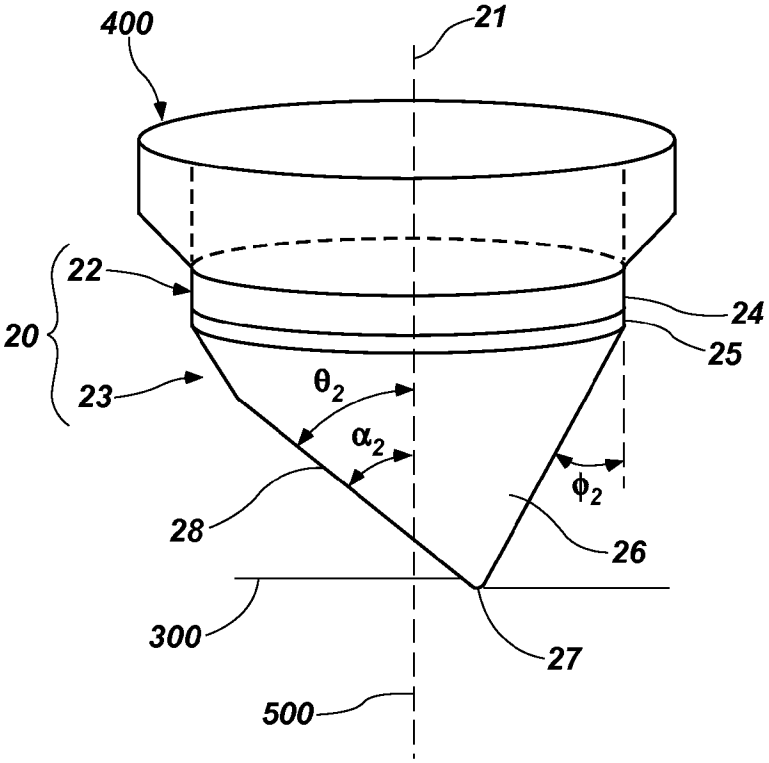
FIGS. 13 and 14 are side perspective views of different embodiments of cutting elements of the invention wherein the cutting elements are mounted on a drilling tool and provided with a neutral physical back rake angle (e.g., physical neutral rake) and a positive effective back rake angle (e.g., effective back rake) relative to a formation surface.
Figure 13:
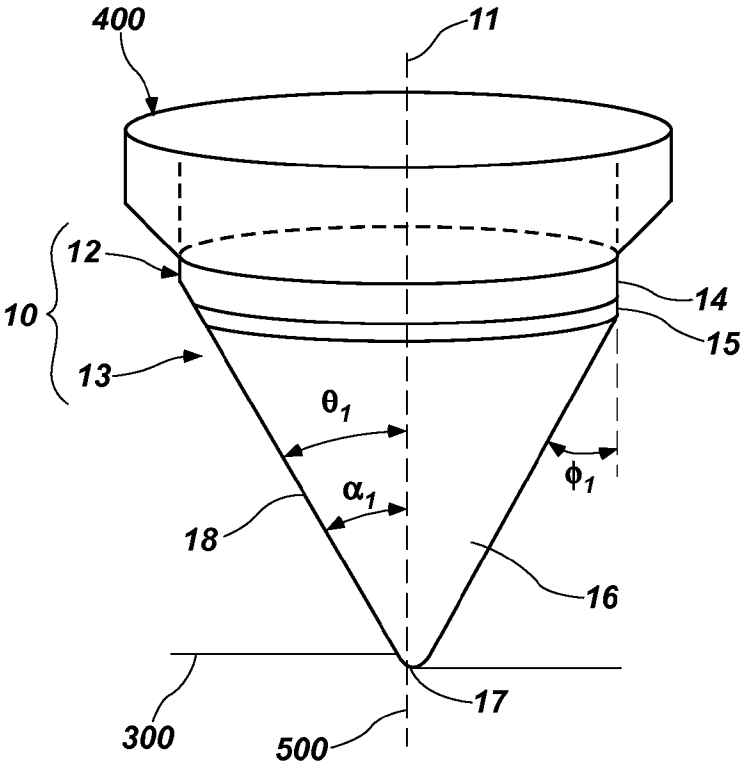

A magnitude of each of the effective rake angles $\theta_1$ and $\theta_2$ may be at least partially determined by an orientation in which each of the respective cutting elements 10 and 20 is attached to the earth-boring tool. With continued reference to FIGS. 9-18, each of the cutting elements 10 and 20 may be attached to the earth-boring tool as to include respective physical back rake angles $\pi_1$ and $\pi_2$ that may be negative (i.e., physical forward rake), positive (i.e., physical back rake), or neutral (i.e., physical neutral rake). The physical back rake angles $\pi_1$ and $\pi_2$ may be considered negative where at least a portion of the respective longitudinal axes 11 and 21 extending through the respective cutting elements 10 and 20 are behind the reference plane 500 (i.e., the longitudinal axes 11 and 21 form an obtuse angle with the surface of the subterranean formation 300), as in depicted in FIGS. 9, 10, and 15-18 (the vertically opposite physical back rake angles $\pi_1$ and $\pi_2$ being marked therein). The physical back rake angles $\pi_1$ and $\pi_2$ may be considered positive where at least a portion of the corresponding longitudinal axes 11 and 21 extending through the cutting elements 10 and 20 are ahead the reference plane 500 (i.e., the longitudinal axes form an acute angle with the surface of the subterranean formation 300), as depicted in FIGS. 11 and 12 (the vertically opposite physical back rake angles $\eta_1$ and $\pi_2$ being marked therein). The physical back rake angles $\pi_1$ and $\pi_2$ may be considered neutral where the corresponding longitudinal axes 11 and 21 are parallel with the reference plane 500, as depicted in FIGS. 13 and 14.

The magnitude of each of the effective back rake angles $\theta_1$ and $\theta_2$ may also be affected by the magnitudes of the angles $\alpha_1$ and $\alpha_2$ between the longitudinal axes 11 and 21 and the flat cutting surfaces 18 and 28, respectively. The magnitudes of the angles $\alpha_1$ and $\alpha_2$ may be influenced at least by the respective locations of the apex 17 and the apex 27 on the corresponding cutting tips 13 and 23, the length of the respective flat cutting surfaces 18 and 28, and the respective angles $\phi_1$ and $\phi_2$ between the corresponding generally conical surfaces 16 and 26 and the corresponding phantom lines extending from the generally cylindrical lateral side surfaces 15 and 25 of the cutting elements 10 and 20.

The physical back rake angles $\pi_1$ and $\pi_2$, the size and shape of the flat cutting surfaces 18 and 28, and the effective back rake angles $\theta_1$ and $\theta_2$ of the cutting tips 13 and 23, respectively, may each be tailored to optimize the performance of the cutting elements 10 and 20 for the earth-boring tool being used and characteristics of the surface 300 of the subterranean formation 300. The non-limiting embodiments illustrated in FIGS. 9-18 include different combinations of these variables that may result in effective back rake angles $\theta_1$ and $\theta_2$ of between about thirty degrees (30°) negative back rake and about forty-five degrees (45°) positive back rake of the reference plane 500.

FIGS. 9 and 10 illustrate that the cutting elements 10 and 20 may be formed and oriented on an earth-boring tool such that the corresponding physical back rake angles $\pi_1$ and $\pi_2$ are negative (i.e., physical forward rake) and the effective back rake angles $\theta_1$ and $\theta_2$ are negative (i.e., effective forward rake). FIG. 9 shows the side perspective view of the embodiment of the cutting element 10 illustrated in FIG. 1, as oriented on the earth-boring tool to include a physical back rake angle $\pi_1$ that is negative. FIG. 10 shows the side perspective view of the embodiment of the cutting element 20 illustrated in FIG. 4, as oriented on the earth-boring tool to include a physical back rake angle $\pi_2$ that is negative. In embodiments including relatively larger angles $\alpha_1$ and $\alpha_2$, the corresponding effective back rake angles $\theta_1$ and $\theta_2$ may be closer to neutral. In embodiments including relatively larger angles $\alpha_1$ and $\alpha_2$, the corresponding physical rake angles $\pi_1$ and $\pi_2$ may be more negative to facilitate effective back rake angles $\theta_1$ and $\theta_2$ that are negative. Conversely, in embodiments including relatively smaller angles $\alpha_1$ and $\alpha_2$, the corresponding physical back rake angles $\pi_1$ and $\pi_2$ may be less negative (i.e., closer to zero degrees), while still including effective back rake angles $\theta_1$ and $\theta_2$ that are negative.

FIGS. 11 and 12 illustrate that the cutting elements 10 and 20 may be formed and oriented on an earth-boring tool such that the corresponding physical back rake angles $\pi_1$ and $\pi_2$ are positive (i.e., physical back rake) and the respective effective back rake angles $\theta_1$ and $\theta_2$ are positive (i.e., effective back rake). FIG. 11 shows the side perspective view of the embodiment of the cutting element 10 illustrated in FIG. 1, as oriented on the earth-boring tool to include a physical back rake angle $\pi_1$ that is positive. FIG. 12 shows the side perspective view of the embodiment of the cutting element 20 illustrated in FIG. 4, as oriented on the earth-boring tool to include a physical back rake angle $\pi_2$ that is positive. In embodiments including relatively larger angles $\alpha_1$ and $\alpha_2$, the corresponding effective back rake angles $\theta_1$ and $\theta_2$ may be more positive. In embodiments including relatively larger angles $\alpha_1$ and $\alpha_2$, the corresponding physical rake angles $\pi_1$ and $\pi_2$ may be more negative to facilitate effective back rake angles $\theta_1$ and $\theta_2$ that are within forty-five degrees (45°) of positive back rake angle relative to the reference plane 500. Conversely, in embodiments including relatively smaller angles $\alpha_1$ and $\alpha_2$, the corresponding physical rake angles $\pi_1$ and $\pi_2$ may be more positive while still including respective back rake angles $\theta_1$ and $\theta_2$ within forty-five degrees (45°) of positive back rake angle relative to the reference plane 500.

FIGS. 13 and 14 illustrate that cutting elements 10 and 20 may be formed and oriented on an earth-boring tool such that the corresponding effective back rake angles $\theta_1$ and $\theta_2$ are positive (i.e., effective back rake), and respective physical back rake angles $\pi_1$ and $\pi_2$ are neutral (i.e., physical neutral rake). FIG. 13 shows the side perspective view of the embodiment of the cutting element 10 illustrated in FIG. 1, as oriented on the earth-boring tool to include a physical back rake angle $\pi_1$ that is neutral. FIG. 14 shows the side perspective view of the embodiment of the cutting element 20 illustrated in FIG. 4, as oriented on the earth-boring tool to include a physical back rake angle $\pi_2$ that is neutral. The magnitudes of the angles $\alpha_1$ and $\alpha_2$ may affect the sign and magnitude of the effective back rake angles $\theta_1$ and $\theta_2$. In embodiments including relatively larger angles $\alpha_1$ and $\alpha_2$, the corresponding effective back rake angles $\theta_1$ and $\theta_2$ may be closer to forty-five degrees (45°) of positive back rake angle relative to the reference plane 500. In embodiments including relatively smaller angles $\alpha_1$ and $\alpha_2$, the corresponding effective back rake angles $\theta_1$ and $\theta_2$ may be closer to neutral.

Figure 15:
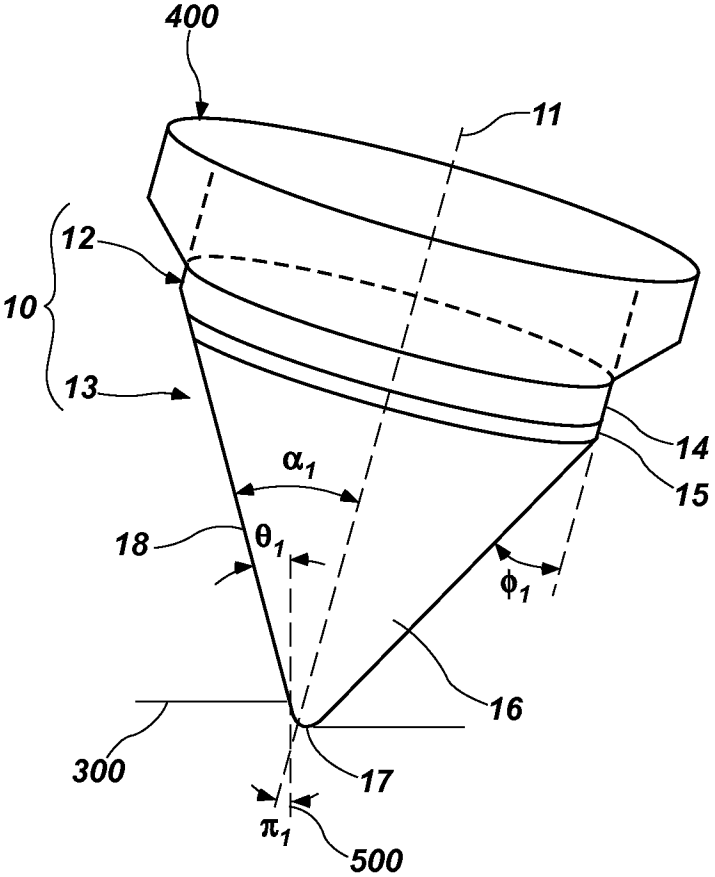

FIGS. 15 and 16 illustrate that cutting elements 10 and 20 may be formed and oriented on an earth-boring tool such that the corresponding the effective back rake angles $\theta_1$ and $\theta_2$ are positive (i.e., effective back rake), and the respective physical back rake angles $\pi_1$ and $\pi_2$ are negative (i.e., physical forward rake). FIG. 15 shows the side perspective view of the embodiment of the cutting element 10 illustrated in FIG. 1, as oriented on the earth-boring tool to include a physical back rake angle $\pi_1$ that is negative. FIG. 16 shows the side perspective view of the embodiment of the cutting element 20 illustrated in FIG. 4, as oriented on the earth-boring tool to include a physical back rake angle $\pi_2$ that is negative. In embodiments including relatively larger angles $\alpha_1$ and $\alpha_2$, the corresponding effective back rake angles $\theta_1$ and $\theta_2$ may be more positive. In embodiments including relatively larger angles $\alpha_1$ and $\alpha_2$, the corresponding physical rake angles $\pi_1$ and $\pi_2$ may be more negative to facilitate effective back rake angles $\theta_1$ and $\theta_2$ that are about forty-five degrees (45°) of positive back rake to the reference plane 500 or less. Conversely, in embodiments including relatively smaller angles $\alpha_1$ and $\alpha_2$, the effective back rake angles $\theta_1$ and $\theta_2$ may be closer to neutral. In at least some embodiments including relatively smaller angles $\alpha_1$ and $\alpha_2$, the corresponding physical back rake angles $\pi_1$ and $\pi_2$ may be more positive to facilitate effective back rake angles $\theta_1$ and $\theta_2$ that are negative.

FIGS. 17 and 18 illustrate that cutting elements 10 and 20 may be formed and oriented on an earth-boring tool such that the corresponding the effective back rake angles $\theta_1$ and $\theta_2$ are neutral (i.e., effective back rake), and the physical back rake angles $\pi_1$ and $\pi_2$ are negative (i.e., physical forward rake). FIG. 17 shows the side perspective view of the embodiment of the cutting element 10 illustrated in FIG. 1, as oriented on the earth-boring tool to include a physical back rake angle $\pi_1$ that is negative. FIG. 18 shows the side perspective view of the embodiment of the cutting element 20 illustrated in FIG. 4, as oriented on the earth-boring tool to include a physical back rake angle $\pi_2$ that is negative. In embodiments including relatively larger angles $\alpha_1$ and $\alpha_2$, the corresponding physical back rake angles $\pi_1$ and $\pi_2$ may be more negative to facilitate corresponding effective back rake angles $\theta_1$ and $\theta_2$ that are neutral. Conversely, in embodiments including relatively smaller angles $\alpha_1$ and $\alpha_2$, the corresponding physical back rake angles $\pi_1$ and $\pi_2$ may be more positive to facilitate corresponding effective back rake angles $\theta_1$ and $\theta_2$ that are neutral.

The enhanced shape of the cutting elements described herein may be used to improve the behavior and durability of the cutting elements when drilling in subterranean earth formations. The shape of the cutting elements may allow the cutting element to fracture and damage the formation, while also providing increased efficiency in the removal of the fractured formation material from the subterranean surface of the wellbore. The shape of the cutting elements may be used to provide a positive, negative, or neutral effective back rake angle, regardless of whether the cutting element has a positive, negative, or neutral physical back rake angle.

While the present invention has been described herein with respect to certain embodiments, those of ordinary skill in the art will recognize and appreciate that it is not so limited. Rather, many additions, deletions and modifications to the embodiments described herein may be made without departing from the scope of the invention as hereinafter claimed, including legal equivalents. In addition, features from one embodiment may be combined with features of another embodiment while still being encompassed within the scope of the invention as contemplated by the inventor.

What is claimed is:

1. An earth-boring tool, comprising:

at least one shaped cutting element attached to at least one structure of the earth-boring tool, the at least one shaped cutting element comprising:

a substrate base attached to at least one surface of the at least one structure; and a volume of polycrystalline diamond material on an end of the substrate base, the volume of polycrystalline diamond material comprising:

an apex centered about a longitudinal axis extending through a center of the substrate base;

a generally conical surface extending at a first angle from the substrate base to the apex; and a flat cutting surface opposing the generally conical surface and extending at a second, different angle from a first point at least substantially proximate a center of the apex to a second point on the at least one shaped cutting element more proximate a lateral side surface of the substrate base.

2. The earth-boring tool of claim 1, further comprising a plurality of blades, at least one blade of the plurality of blades comprising the at least one structure of the earth-boring tool.

3. The earth-boring tool of claim 1, further comprising a plurality of roller cones, at least one roller cone of the plurality of roller cones comprising the at least one structure of the earth-boring tool.

4. The earth-boring tool of claim 1, wherein the at least one shaped cutting element exhibits a negative physical back rake angle and a negative effective back rake angle.

5. The earth-boring tool of claim 1, wherein the at least one shaped cutting element exhibits a negative physical back rake angle and a neutral effective back rake angle.

6. The earth-boring tool of claim 1, wherein the at least one shaped cutting element exhibits a negative physical back rake angle and a positive effective back rake angle.

7. The earth-boring tool of claim 1, wherein the at least one shaped cutting element exhibits a neutral physical back rake angle and a negative effective back rake angle.

8. The earth-boring tool of claim 1, wherein the at least one shaped cutting element exhibits a neutral physical back rake angle and a positive effective back rake angle.

9. The earth-boring tool of claim 1, wherein the at least one shaped cutting element exhibits a positive physical back rake angle and a positive effective back rake angle.

10. The earth-boring tool of claim 1, wherein the at least one shaped cutting element comprises at least two shaped cutting elements, a first of the at least two shaped cutting elements exhibiting at least one of a different physical back rake angle or a different effective back rake angle than a second of the at least two shaped cutting elements.

11. The earth-boring tool of claim 1, wherein the first angle is within a range of from about thirty degrees (30°) to about sixty degrees (60°) between the generally conical surface and a phantom line extending from the lateral side surface of the substrate base, and wherein the second, different angle is within a range of from about fifteen degrees (15°) to about ninety degrees (90°) between the flat cutting surface and the longitudinal axis.

12. An earth-boring tool, comprising:

at least one shaped cutting element attached to at least one structure of the earth-boring tool, the at least one shaped cutting element comprising:

a substrate base attached to at least one surface of the at least one structure; and a volume of polycrystalline diamond material on an end of the substrate base, the volume of polycrystalline diamond material comprising:

a generally conical surface;

an apex offset from a longitudinal axis extending through a center of the substrate base; and a flat cutting surface extending from a first point at least substantially proximate a center of the apex to a second point on the at least one shaped cutting element more proximate a lateral side surface of the substrate base, a distance between the first point and the second point greater than a distance between the second point and the lateral side surface of the substrate base.

13. The earth-boring tool of claim 12, further comprising a plurality of blades, at least one blade of the plurality of blades comprising the at least one structure of the earth-boring tool.

14. The earth-boring tool of claim 12, wherein the at least one shaped cutting element exhibits a negative physical back rake angle, and either a negative effective back rake angle, a neutral effective back rake angle, or a positive effective back rake angle.

15. The earth-boring tool of claim 12, wherein the at least one shaped cutting element exhibits a neutral physical back rake angle, and either a negative effective back rake angle or a positive effective back rake angle.

16. The earth-boring tool of claim 12, wherein the at least one shaped cutting element exhibits a positive physical back rake angle and a positive effective back rake angle.

17. The earth-boring tool of claim 12, wherein the at least one shaped cutting element comprises at least two shaped cutting elements, a first of the at least two shaped cutting elements exhibiting at least one of a different physical back rake angle or a different effective back rake angle than a second of the at least two shaped cutting elements.

18. The earth-boring tool of claim 12, wherein a first angle within a range of from about thirty degrees (30°) to about sixty degrees (60°) exists between the generally conical surface and a phantom line extending from the lateral side surface of the substrate base, and wherein a second angle within a range of from about fifteen degrees (15°) to about ninety degrees (90°) exists between the flat cutting surface and the longitudinal axis.

19. The earth-boring tool of claim 12, further comprising:

at least one additional shaped cutting element attached to the at least one structure of the earth-boring tool, the at least one additional shaped cutting element comprising:

an additional substrate base attached to the at least one surface of the at least one ether structure; and another volume of polycrystalline diamond material on an end of the additional substrate base, the another volume of polycrystalline diamond material comprising:

an additional apex centered about another longitudinal axis extending through a center of the additional substrate base;

an additional generally conical surface extending at a first angle from the additional substrate base to the additional apex; and an additional flat cutting surface opposing the additional generally conical surface and extending at a second, different angle from a point at least substantially proximate a center of the additional apex to another point on the at least one additional shaped cutting element more proximate a lateral side surface of the additional substrate base.

20. A method of removing material from a subterranean formation, comprising:

rotating an earth-boring tool within a wellbore in the subterranean formation, the earth-boring tool comprising:

at least one shaped cutting element attached to at least one structure of the earth-boring tool, the at least one shaped cutting element comprising:

a substrate base attached to at least one surface of the at least one structure;

a generally conical surface extending at a first angle from the substrate base to an apex; and a flat cutting surface opposing the generally conical surface and extending at a second, different angle from a first point substantially proximate a center of the apex to a second point more proximate a lateral sidewall of the substrate base, the flat cutting surface contacting a surface of the subterranean formation at an angle within a range of from about forty-five degrees (45°) to about one hundred twenty degrees (120°) during rotation of the earth-boring tool.

* * * * *